US007138047B2

(12) United States Patent
Stell et al.

(10) Patent No.: US 7,138,047 B2
(45) Date of Patent: Nov. 21, 2006

(54) PROCESS FOR STEAM CRACKING HEAVY HYDROCARBON FEEDSTOCKS

(75) Inventors: Richard C. Stell, Houston, TX (US); Arthur R. DiNicolantonio, Seabrook, TX (US); James Mitchell Frye, Pebble Bay (SG); David B. Spicer, Houston, TX (US); James N. McCoy, Houston, TX (US); Robert David Strack, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 397 days.

(21) Appl. No.: 10/188,461

(22) Filed: Jul. 3, 2002

(65) Prior Publication Data

US 2004/0004022 A1 Jan. 8, 2004

(51) Int. Cl.
*C10G 9/36* (2006.01)

(52) U.S. Cl. ..... 208/130; 208/125; 208/128; 208/132; 208/652; 208/48 R

(58) Field of Classification Search ..... 208/48 R, 208/125, 128, 130, 132; 585/652
See application file for complete search history.

(56) References Cited

U.S. PATENT DOCUMENTS

| | | | | |
|---|---|---|---|---|
| 1,936,699 | A | 11/1933 | Weaver | |
| 1,984,569 | A | 12/1934 | Cooke et al. | 196/66 |
| 2,091,261 | A | 8/1937 | Alther | 196/49 |
| 2,158,425 | A | 5/1939 | Ragatz | 196/73 |
| 3,291,573 | A | 12/1966 | Frescoln | |
| 3,341,429 | A | 9/1967 | Fondrk | |
| 3,413,211 | A | 11/1968 | Becraft et al. | 208/93 |
| 3,487,006 | A | 12/1969 | Newman et al. | 208/93 |
| 3,492,795 | A | 2/1970 | Guerrieri | |
| 3,505,210 | A | 4/1970 | Wallace et al. | |
| 3,617,493 | A | 11/1971 | Wirth et al. | 208/80 |
| 3,677,234 | A | 7/1972 | Dutkiewicz | |
| 3,718,709 | A | 2/1973 | Simonetta | 260/683 R |
| 3,900,300 | A | 8/1975 | Lehman | |
| 4,199,409 | A | 4/1980 | Skraba | |
| 4,264,432 | A | 4/1981 | Gartside | 208/48 R |
| 4,300,998 | A | 11/1981 | Gartside | 208/127 |
| 4,311,580 | A | 1/1982 | Bartholic | 208/91 |
| 4,361,478 | A | 11/1982 | Gengler et al. | |

(Continued)

FOREIGN PATENT DOCUMENTS

DE 10 93 351 11/1960

(Continued)

OTHER PUBLICATIONS

Dennis A. Duncan and Vance A. Ham, Stone & Webster, "The Practicalities of Steam-Cracking Heavy Oil", Mar. 29-Apr. 2, 1992, AIChE Spring National Meeting in New Orleans, LA, pp. 1-41.

(Continued)

*Primary Examiner*—Thuan Dinh Dang
(74) *Attorney, Agent, or Firm*—James A. Zboray

(57) ABSTRACT

A process for feeding or cracking heavy hydrocarbon feedstock containing non-volatile hydrocarbons comprising: heating the heavy hydrocarbon feedstock, mixing the heavy hydrocarbon feedstock with a fluid and/or a primary dilution steam stream to form a mixture, flashing the mixture to form a vapor phase and a liquid phase, and varying the amount of the fluid and/or the primary dilution steam stream mixed with the heavy hydrocarbon feedstock in accordance with at least one selected operating parameter of the process, such as the temperature of the flash stream before entering the flash drum.

43 Claims, 1 Drawing Sheet

U.S. PATENT DOCUMENTS

| | | | | |
|---|---|---|---|---|
| 4,400,182 | A | 8/1983 | Davies et al. | |
| 4,426,278 | A | 1/1984 | Kosters | 208/130 |
| 4,543,177 | A | 9/1985 | Murthy et al. | 208/130 |
| 4,615,795 | A | 10/1986 | Woebcke et al. | 208/72 |
| 4,714,109 | A | 12/1987 | Tsao | |
| 4,732,740 | A | 3/1988 | Woebcke et al. | 422/193 |
| 4,840,725 | A | 6/1989 | Paspek | 208/130 |
| 4,854,944 | A | 8/1989 | Strong | 48/214 R |
| 4,954,247 | A | 9/1990 | Lipkin et al. | |
| 5,096,567 | A | 3/1992 | Paspek, Jr. et al. | 208/106 |
| 5,120,892 | A | 6/1992 | Skraba | 585/652 |
| 5,190,634 | A | 3/1993 | Fernandez-Baujin et al. | 208/107 |
| 5,468,367 | A | 11/1995 | Dickakian et al. | |
| 5,580,443 | A | 12/1996 | Yoshida et al. | 208/130 |
| 5,817,226 | A | 10/1998 | Lenglet | |
| 5,910,440 | A | 6/1999 | Grossman et al. | |
| 6,093,310 | A | 7/2000 | Swan | |
| 6,123,830 | A | 9/2000 | Gupta et al. | |
| 6,179,997 | B1 | 1/2001 | Vedder, Jr. et al. | 208/113 |
| 6,190,533 | B1 | 2/2001 | Bradow et al. | |
| 6,210,561 | B1 | 4/2001 | Bradow et al. | |
| 6,303,842 | B1 | 10/2001 | Bridges et al. | |
| 6,376,732 | B1 | 4/2002 | Ngan et al. | |
| 6,632,351 | B1 | 10/2003 | Ngan et al. | 208/132 |
| 6,743,961 | B1 | 6/2004 | Powers | |
| 2001/0016673 | A1 | 8/2001 | Bridges et al. | |
| 2003/0070963 | A1 | 4/2003 | Zimmermann et al. | |
| 2004/0039240 | A1 | 2/2004 | Powers | |
| 2004/0054247 | A1 | 3/2004 | Powers | |
| 2005/0010075 | A1 | 1/2005 | Powers | |

FOREIGN PATENT DOCUMENTS

| | | |
|---|---|---|
| EP | 0063448 | 10/1982 |
| FR | 1472280 | 3/1967 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2 006 259 | 5/1979 |
| GB | 2 012 176 | 7/1979 |
| JP | 3111491 | 5/1991 |
| NL | 7410163 | 4/1975 |
| SU | 1491552 | 7/1989 |
| WO | WO 01/55280 | 8/2001 |
| WO | WO 2004/005431 | 1/2004 |
| WO | WO 2004/005432 | 1/2004 |
| WO | WO 2004/005433 | 1/2004 |
| ZA | 907394 | 9/1990 |

OTHER PUBLICATIONS

ABB Lummus Crest Inc., (presentation) HOPS, "Heavy Oil Processing System", Jun. 15, 1992 TCC PEW Meeting, pp. 1-18.

Lummus Crest Inc., JP03111491 (Abstract), May 13, 1991.

Mitsui Sekka Engineering Co., Ltd/Mitsui Engineering & Shipbuilding Co., Ltd., "Mitsui Advanced Cracker & Mitsui Innovative Quencher", pp. 1-16.

"Specialty Furnace Design: Steam Reformers and Steam Crackers", presented by T.A. Wells of the M.W. Kellogg Company, 1988 AIChE Spring National Meeting.

PROCESS FOR STEAM CRACKING HEAVY HYDROCARBON FEEDSTOCKS

BACKGROUND OF THE INVENTION

1. Field of the Invention

The present invention relates to the cracking of hydrocarbons that contain relatively non-volatile hydrocarbons and other contaminants.

2. Description of Background and Related Art

Steam cracking has long been used to crack various hydrocarbon feedstocks into olefins. Conventional steam cracking utilizes a pyrolysis furnace which has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products including olefins leave the pyrolysis furnace for further downstream processing, such as quenching.

Conventional steam cracking systems have been effective for cracking high-quality feedstock which contain a large fraction of light volatile hydrocarbons, such as gas oil and naphtha. However, steam cracking economics sometimes favor cracking lower cost heavy feedstocks such as, by way of non-limiting examples, crude oil and atmospheric resid. Crude oil and atmospheric resid contain high molecular weight, non-volatile components with boiling points in excess of 1100° F. (590° C.). The non-volatile, components of these feedstocks lay down as coke in the convection section of conventional pyrolysis furnaces. Only very low levels of non-volatile components can be tolerated in the convection section downstream of the point where the lighter components have fully vaporized. Additionally, during transport some naphthas are contaminated with heavy crude oil containing non-volatile components. Conventional pyrolysis furnaces do not have the flexibility to process resids, crudes, or many resid or crude contaminated gas oils or naphthas which are contaminated with non-volatile components hydrocarbons.

To solve such coking problem, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 450 to 1100° F. (230 to 600° C.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It provides preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

The present inventors have recognized that in using a flash to separate heavy liquid hydrocarbon fractions from the lighter fractions which can be processed in the pyrolysis furnace, it is important to effect the separation so that most of the non-volatile components will be in the liquid phase. Otherwise, heavy, coke-forming non-volatile components in the vapor are carried into the furnace causing coking problems.

The present inventors have also recognized that in using a flash to separate non-volatile components from the lighter fractions of the hydrocarbon feedstock, which can be processed in the pyrolysis furnace without causing coking problems, it is important to carefully control the ratio of vapor to liquid leaving the flash. Otherwise, valuable lighter fractions of the hydrocarbon feedstock could be lost in the liquid hydrocarbon bottoms or heavy, coke-forming components could be vaporized and carried as overhead into the furnace causing coking problems.

The control of the ratio of vapor to liquid leaving flash has been found to be difficult because many variables are involved. The ratio of vapor to liquid is a function of the hydrocarbon partial pressure in the flash and also a function of the temperature of the stream entering the flash. The temperature of the stream entering the flash varies as the furnace load changes. The temperature is higher when the furnace is at full load and is lower when the furnace is at partial load. The temperature of the stream entering the flash also varies according to the flue gas temperature in the furnace that heats the feedstock. The flue-gas temperature in turn varies according to the extent of coking that has occurred in the furnace. When the furnace is clean or very lightly coked, the flue-gas temperature is lower than when the furnace is heavily coked. The flue-gas temperature is also a function of the combustion control exercised on the burners of the furnace. When the furnace is operated with low levels of excess oxygen in the flue gas, the flue gas temperature in the mid to upper zones of the convection section will be lower than that when the furnace is operated with higher levels of excess oxygen in the flue-gas. With all these variables, it is difficult to control a constant ratio of vapor to liquid leaving the flash.

The present invention offers an advantageously controlled process to optimize the cracking of volatile hydrocarbons contained in the heavy hydrocarbon feedstocks and to reduce and avoid the coking problems. The present invention provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream mixed with the heavy hydrocarbon feedstock prior to the flash. The fluid optionally is water.

The present invention also provides a method to maintain a relatively constant hydrocarbon partial pressure of the flash stream. The constant hydrocarbon partial pressure is maintained by controlling the flash pressure and the ratio of fluid and steam to the hydrocarbon feedstock.

Separate applications, one entitled "CONVERTING MIST FLOW TO ANNULAR FLOW IN THERMAL CRACKING APPLICATION," U.S. application Ser. No. 10/189,615 Family Number 2002B064, filed Jul. 3, 2002, and one entitled "PROCESS FOR CRACKING HYDROCARBON FEED WITH WATER SUBSTITUTION", U.S. application Ser. No. 10/188,901, Family Number 2002B091US, filed Jul. 3, 2002, are being concurrently filed herewith and are incorporated herein by reference.

SUMMARY OF THE INVENTION

The present invention provides a process for heating heavy hydrocarbon feedstock which comprises heating a heavy hydrocarbon, mixing the heavy hydrocarbon with fluid to form a mixture, flashing the mixture to form a vapor phase and a liquid phase, and varying the amount of fluid mixed with the heavy hydrocarbon in accordance with at least one selected operating parameter of the process and feeding the vapor phase to a furnace. The fluid can be a liquid hydrocarbon or water.

According to one embodiment, at least one operating parameter may be the temperature of the heated heavy hydrocarbon before it is flashed. At least one operating parameter may also be at least one of the flash pressure, temperature of the flash stream, flow rate of the flash stream, and excess oxygen in the flue gas.

In a preferred embodiment, the heavy hydrocarbon is mixed with a primary dilution steam stream before the flash. Furthermore, a secondary dilution steam can be superheated in the furnace and then mixed with the heavy hydrocarbon.

The present invention also provides a process for cracking a heavy hydrocarbon feedstock in a furnace which is comprised of radiant section burners which provide radiant heat and hot flue gas and a convection section comprised of multiple banks of heat exchange tubes comprising:

(a) preheating the heavy hydrocarbon feedstock to form a preheated heavy hydrocarbon feedstock;

(b) mixing the preheated heavy hydrocarbon feedstock with water to form a water heavy hydrocarbon mixture;

(c) injecting primary dilution steam into the water heavy hydrocarbon mixture to form a mixture stream;

(d) heating the mixture stream in a bank of heat exchange tubes by indirect heat transfer with the hot flue gas to form a hot mixture stream;

(e) controlling the temperature of the hot mixture stream and controlling the ratio of steam to hydrocarbon by varying the flow rate of the water and the flow rate of the primary dilution steam;

(f) flashing the hot mixture stream in a flash drum to form a vapor phase and liquid phase and separating the vapor phase from the liquid phase;

(g) feeding the vapor phase into the convection section of the furnace to be further heated by the hot flue gas from the radiant section of the furnace to form a heated vapor phase; and (h) feeding the heated vapor phase to the radiant section tubes of the furnace wherein the hydrocarbons in the vapor phase thermally crack to form products due to the radiant heat.

DETAILED DESCRIPTION OF THE INVENTION

Figure 1:
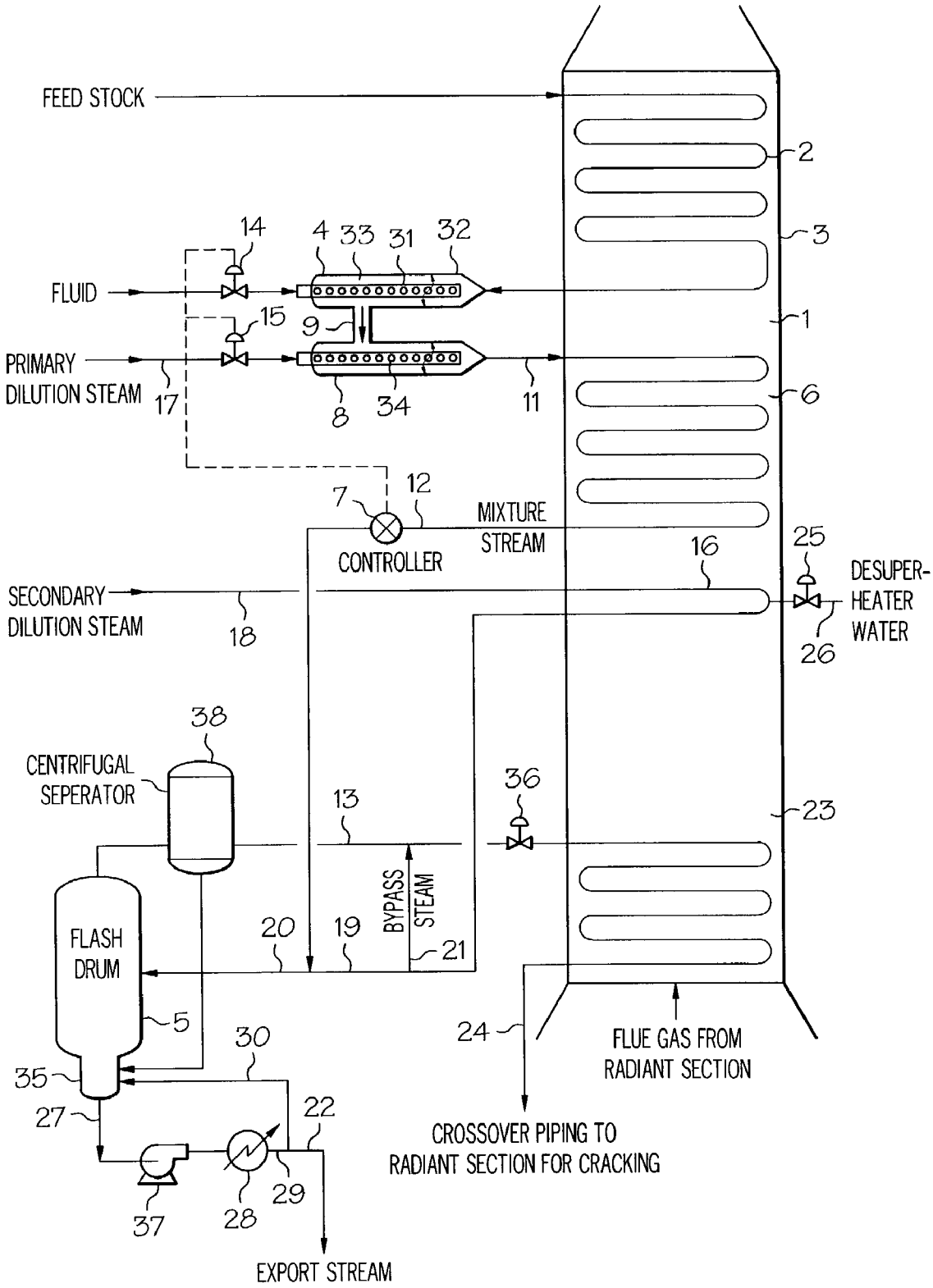
FIG. 1 illustrates a schematic flow diagram of a process in accordance with the present invention employed with a steam cracking furnace, specifically the convection section.

Unless otherwise stated, all percentages, parts, ratios, etc., are by weight. Unless otherwise stated, a reference to a compound or component includes the compound or component by itself, as well as in combination with other compounds or components, such as mixtures of compounds.

Further, when an amount, concentration, or other value or parameters is given as a list of upper preferable values and lower preferable values, this is to be understood as specifically disclosing all ranges formed from any pair of an upper preferred value and a lower preferred value, regardless whether ranges are separately disclosed.

Also as used herein: Non-volatile components can be measured as follows: The boiling point distribution of the hydrocarbon feed is measured by Gas Chromatograph Distillation (GCD) by ASTM D-6352-98 or another suitable method. The Non-volatile components are the fraction of the hydrocarbon with a nominal boiling point above 1100° F. (590° C.) as measured by ASTM D-6352-98. More preferably, non-volatiles have a nominal boiling point above 1400° F. (760° C.).

The present invention relates to a process for heating and steam cracking heavy hydrocarbon feedstock. The process comprises heating a heavy hydrocarbon, mixing the heavy hydrocarbon with a fluid to form a mixture, flash the mixture to form a vapor phase and a liquid phase, and varying the amount of fluid mixed with the heavy hydrocarbon in accordance with at least one selected operating parameter of the process.

As noted, the feedstock comprises a large portion, about 5 to 50%, of heavy non-volatile components. Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric resid, heavy residium, C4's/residue admixture, and naphtha residue admixture.

The heavy hydrocarbon feedstock has a nominal end boiling point of at least 600° F. (310° C.). The preferred feedstocks are low sulfur waxy resids, atmospheric resids, and naphthas contaminated with crude. The most preferred is resid comprising 60–80% components having boiling points below 100° F. (590° C.), for example, low sulfur waxy resids.

The heavy hydrocarbon feedstock is first preheated in the upper convection section 3. The heating of the heavy hydrocarbon feedstock can take any form known by those of ordinary skill in the art. However, it is preferred that the heating comprises indirect contact of the feedstock in the upper convection section 3 of the furnace 1 with hot flue gases from the radiant section of the furnace. This can be accomplished, by way of non-limiting example, by passing the feedstock through a bank of heat exchange tubes 2 located within the convection section 3 of the furnace 1. The preheated feedstock has a temperature between 300 to 500° F. (150 to 260° C.). Preferably the temperature of the heated feed is about 325 to 450° F. (160 to 230° C.) and more preferably between 340 to 425° F. (170 to 220° C.).

The preheated heavy hydrocarbon feedstock is mixed with a fluid. The fluid can be a liquid hydrocarbon, water, steam, or mixture thereof. The preferred fluid is water. The temperature of the fluid can be below, equal to or above the temperature of the preheated feedstock.

The mixing of the preheated heavy hydrocarbon feedstock and the fluid can occur inside or outside the pyrolysis furnace 1, but preferably it occurs outside the furnace. The mixing can be accomplished using any mixing device known within the art. However it is preferred to use a first sparger 4 of a double sparger assembly 9 for the mixing. The first sparger 4 preferably comprises an inside perforated conduit 31 surrounded by an outside conduit 32 so as to form an annular flow space 33 between the inside and outside conduit. Preferably, the preheated heavy hydrocarbon feedstock flows in the annular flow space and the fluid flows through the inside conduit and is injected into the feedstock through the openings in the inside conduit, preferably small circular holes. The first sparger 4 is provided to avoid or to reduce hammering, caused by sudden vaporization of the fluid, upon introduction of the fluid into the preheated heavy hydrocarbon feedstock.

The present invention uses steam streams in various parts of the process. The primary dilution steam stream 17 is mixed with the preheated heavy hydrocarbon feedstock as detailed below. In a preferred embodiment, a secondary dilution steam stream 18 is treated in the convection section and mixed with the heavy hydrocarbon fluid primary dilution steam mixture before the flash. The secondary dilution steam 18 is optionally split into a bypass steam 21 and a flash steam 19.

In a preferred embodiment in accordance with the present invention, in addition to the fluid mixed with the preheated heavy feedstock, the primary dilution steam 17 is also mixed with the feedstock. The primary dilution steam stream can be preferably injected into a second sparger 8. It is preferred that the primary dilution steam stream is injected into the heavy hydrocarbon fluid mixture before the resulting stream mixture enters the convection section at 11 for additional heating by radiant section flue gas. Even more preferably, the primary dilution steam is injected directly into the second sparger 8 so that the primary dilution steam passes through the sparger and is injected through small circular flow distribution holes 34 into the hydrocarbon feedstock fluid mixture.

The primary dilution steam can have a temperature greater, lower or about the same as heavy hydrocarbon feedstock fluid mixture but preferably greater than that of the mixture and serves to partially vaporize the feedstock/fluid mixture. Preferably, the primary dilution steam is superheated before being injected into the second sparger 8.

The mixture of the fluid, the preheated heavy hydrocarbon feedstock, and the primary dilution steam stream leaving the second sparger 8 is heated again in the pyrolysis furnace 3 before the flash. The heating can be accomplished, by way of non-limiting example, by passing the feedstock mixture through a bank of heat exchange tubes 6 located within the convection section of the furnace and thus heated by the hot flue gas from the radiant section of the furnace. The thus-heated mixture leaves the convection section as a mixture stream 12 to be further mixed with an additional steam stream.

Optionally, the secondary dilution steam stream 18 can be further split into a flash steam stream 19 which is mixed with the heavy hydrocarbon mixture 12 before the flash and a bypass steam stream 21 which bypasses the flash of the heavy hydrocarbon mixture and, instead is mixed with the vapor phase from the flash before the vapor phase is cracked in the radiant section of the furnace. The present invention can operate with all secondary dilution steam 18 used as flash steam 19 with no bypass steam 21. Alternatively, the present invention can be operated with secondary dilution steam 18 directed to bypass steam 21 with no flash steam 19. In a preferred embodiment in accordance with the present invention, the ratio of the flash steam stream 19 to bypass steam stream 21 should be preferably 1:20 to 20:1, and most preferably 1:2 to 2:1. The flash steam 19 is mixed with the heavy hydrocarbon mixture stream 12 to form a flash stream 20 before the flash in flash drum 5. Preferably, the secondary dilution steam stream is superheated in a superheater section 16 in the furnace convection before splitting and mixing with the heavy hydrocarbon mixture. The addition of the flash steam stream 19 to the heavy hydrocarbon mixture stream 12 ensures the vaporization of nearly all volatile components of the mixture before the flash stream 20 enters the flash drum 5.

The mixture of fluid, feedstock and primary dilution steam stream (the flash stream 20) is then introduced into a flash drum 5 for separation into two phases: a vapor phase comprising predominantly volatile hydrocarbons and a liquid phase comprising predominantly non-volatile hydrocarbons. The vapor phase is preferably removed from the flash drum as an overhead vapor stream 13. The vapor phase, preferably, is fed back to the lower convection section 23 of the furnace for optional heating and through crossover pipes to the radiant section of the pyrolysis furnace for cracking. The liquid phase of the separation is removed from the flash drum 5 as a bottoms stream 27.

It is preferred to maintain a predetermined constant ratio of vapor to liquid in the flash drum 5. But such ratio is difficult to measure and control. As an alternative, temperature of the mixture stream 12 before the flash drum 5 is used as an indirect parameter to measure, control, and maintain the constant vapor to liquid ratio in the flash drum 5. Ideally, when the mixture stream temperature is higher, more volatile hydrocarbons will be vaporized and become available, as a vapor phase, for cracking. However, when the mixture stream temperature is too high, more heavy hydrocarbons will be present in the vapor phase and carried over to the convection furnace tubes, eventually coking the tubes. If the mixture stream 12 temperature is too low, hence a low ratio of vapor to liquid in the flash drum 5, more volatile hydrocarbons will remain in liquid phase and thus will not be available for cracking.

The mixture stream temperature is limited by highest recovery/vaporization of volatiles in the feedstock while avoiding coking in the furnace tubes or coking in piping and vessels conveying the mixture from the flash drum to the furnace 13. The pressure drop across the piping and vessels conveying the mixture to the lower convection section 13, and the crossover piping 24, and the temperature rise across the lower convection section 23 may be monitored to detect the onset of coking problems. For instance, when the crossover pressure and process inlet pressure to the lower convection section 23 begins to increase rapidly due to coking, the temperature in the flash drum 5 and the mixture stream 12 should be reduced. If coking occurs in the lower convection section, the temperature of the flue gas to the superheater 16 increases, requiring more desuperheater water 26.

The selection of the mixture stream 12 temperature is also determined by the composition of the feedstock materials. When the feedatock contains higher amounts of lighter hydrocarbons, the temperature of the mixture stream 12 can be set lower. As a result, the amount of fluid used in the first sparger 4 is increased and/or the amount of primary dilution steam used in the second sparger 8 is decreased since these amounts directly impact the temperature of the mixture stream 12. When the feedstock contains a higher amount of non-volatile hydrocarbons, the temperature of the mixture stream 12 should be set higher. As a result, the amount of fluid used in the first sparger 4 is decreased while the amount of primary dilution steam used in the second sparger 8 is increased. By carefully selecting a mixture stream temperature, the present invention can find applications in a wide variety of feedstock materials.

Typically, the temperature of the mixture stream 12 is set and controlled at between 600 and 950° F. (310 and 510° C.), preferably between 700 and 920° F. (370 and 490° C.), more preferably between 750 and 900° F. (400 and 480° C.), and most preferably between 810 and 890° F. (430 and 475° C.). These values will change with the concentrating volatiles in the feedstock as discussed above.

The temperature of mixture stream 12 is controlled by a control system 7 which comprises at least a temperature sensor and any known control device, such as a computer application. Preferably, the temperature sensors are thermocouples. The control system 7 communicates with the fluid valve 14 and the primary dilution steam valve 15 so that the amount of the fluid and the primary dilution steam entering the two spargers is controlled.

In order to maintain a constant temperature for the mixture stream 12 mixing with flash steam 19 and entering the flash drum to achieve a constant ratio of vapor to liquid in the flash drum 5, and to avoid substantial temperature and flash vapor to liquid ratio variations, the present invention operates as follows: When a temperature for the mixture stream 12 before the flash drum 5 is set, the control system 7 automatically controls the fluid valve 14 and primary dilution steam valve 15 on the two spargers. When the control system 7 detects a drop of temperature of the mixture stream, it will cause the fluid valve 14 to reduce the injection of the fluid into the first sparger 4. If the temperature of the mixture stream starts to rise, the fluid valve will be opened wider to increase the injection of the fluid into the first sparger 4. In the preferred embodiment, the fluid latent heat of vaporization controls mixture stream temperature.

When the primary dilution steam stream 17 is injected to the second sparger 8, the temperature control system 7 can also be used to control the primary dilution steam valve 15 to adjust the amount of primary dilution steam stream injected to the second sparger 8. This further reduces the sharp variation of temperature changes in the flash 5. When the control system 7 detects a drop of temperature of the mixture stream 12, it will instruct the primary dilution steam valve 15 to increase the injection of the primary dilution steam stream into the second sparger 8 while valve 14 is closed more. If the temperature starts to rise, the primary dilution steam valve will automatically close more to reduce the primary dilution steam stream injected into the second sparger 8 while valve 14 is opened wider.

In a preferred embodiment in accordance with the present invention, the control system 7 can be used to control both the amount of the fluid and the amount of the primary dilution steam stream to be injected into both spargers.

In the preferred case where the fluid is water, the controller varies the amount of water and primary dilution steam to maintain a constant mixture stream temperature 12, while maintaining a constant ratio of water-to-feedstock in the mixture 11. To further avoid sharp variation of the flash temperature, the present invention also preferably utilizes an intermediate desuperheater 25 in the superheating section of the secondary dilution steam in the furnace. This allows the superheater 16 outlet temperature to be controlled at a constant value, independent of furnace load changes, coking extent changes, excess oxygen level changes. Normally, this desuperheater 25 ensures that the temperature of the secondary dilution steam is between 800 to 1100° F. (430 to 590°), preferably between 850 to 1000° F. (450 to 540°), more preferably between 850 to 950° F. (450 to 510° C.), and most preferably between 875 to 925° F. (470 to 500° C.). The desuperheater preferably is a control valve and water atomizer nozzle. After partial preheating, the secondary dilution steam exits the convection section and a fine mist of water 26 is added which rapidly vaporizes and reduces the temperature. The steam is then further heated in the convection section. The amount of water added to the superheater controls the temperature of the steam which is mixed with mixture stream 12.

Although it is preferred to adjust the amounts of the fluid and the primary dilution steam streams injected into the heavy hydrocarbon feedstock in the two spargers 4 and 8, according to the predetermined temperature of the mixture stream 12 before the flash drum 5, the same control mechanisms can be applied to other parameters at other locations. For instance, the flash pressure and the temperature and the flow rate of the flash steam 19 can be changed to effect a change in the vapor to liquid ratio in the flash. Also, excess oxygen in the flue gas can also be a control variable, albeit a slow one.

In addition to maintaining a constant temperature of the mixture stream 12 entering the flash drum, it is also desirable to maintain a constant hydrocarbon partial pressure of the flash stream 20 in order to maintain a constant ratio of vapor to liquid in the flash. By way of examples, the constant hydrocarbon partial pressure can be maintained by maintaining constant flash drum pressure through the use of control valves 36 on the vapor phase line 13, and by controlling the ratio of steam to hydrocarbon feedstock in stream 20.

Typically, the hydrocarbon partial pressure of the flash stream in the present invention is set and controlled at between 4 and 25 psia (25 and 175 kPa), preferably between 5 and 15 psia (35 to 100 kPa), most preferably between 6 and 11 psia (40 and 75 kPa).

The flash is conducted in at least one flash drum vessel. Preferably, the flash is a one-stage process with or without reflux. The flash drum 5 is normally operated at 40–200 psia (275–1400 kPa) pressure and its temperature is usually the same or slightly lower than the temperature of the flash stream 20 before entering the flash drum 5. Typically, the pressure of the flash drum vessel is about 40 to 200 psia (275–1400 kPa) and the temperature is about 600 to 950° F. (310 to 510° C.). Preferably, the pressure of the flash drum vessel is about 85 to 155 psia (600 to 1100 kPa) and the temperature is about 700 to 920° F. (370 to 490° C.). More preferably, the pressure of the flash drum vessel is about 105 to 145 psia (700 to 1000 kPa) and the temperature is about 750 to 900° F. (400 to 480° C.). Most preferably, the pressure of the flash drum vessel is about 105 to 125 psia (700 to 760 kPa) and the temperature is about 810 to 890° F. (430 to 480° C.). Depending on the temperature of the flash stream, usually 50 to 95% of the mixture entering the flash drum 5 is vaporized to the upper portion of the flash drum, preferably 60 to 90% and more preferably 65 to 85%, and most preferably 70 to 85%.

The flash drum 5 is operated, in one aspect, to minimize the temperature of the liquid phase at the bottom of the vessel because too much heat may cause coking of the non-volatiles in the liquid phase. Use of the secondary dilution steam stream 18 in the flash stream entering the flash drum lowers the vaporization temperature because it reduces the partial pressure of the hydrocarbons (i.e., larger mole fraction of the vapor is steam), and thus lowers the required liquid phase temperature. It may also be helpful to recycle a portion of the externally cooled flash drum bottoms liquid 30 back to the flash drum vessel to help cool the newly separated liquid phase at the bottom of the flash drum 5. Stream 27 is conveyed from the bottom of the flash drum 5 to the cooler 28 via pump 37. The cooled stream 29 is split into a recycle stream 30 and export stream 22. The temperature of the recycled stream is ideally 500 to 600° F. (260 to 320° C.), preferably 505 to 575° F. (263 to 302° C.), more preferably 515 to 565° F. (268 to 296° C.), and most preferably 520 to 550° F. (270 to 288° C.). The amount of recycled stream should be about 80 to 250% of the amount of the newly separated bottom liquid inside the flash drum, preferably 90 to 225%, more preferably 95 to 210%, and most preferably 100 to 200%.

The flash drum is also operated, in another aspect, to minimize the liquid retention/holding time in the flash drum. Preferably, the liquid phase is discharged from the vessel through a small diameter "boot" or cylinder 35 on the bottom of the flash drum. Typically, the liquid phase retention time in the drum is less than 75 seconds, preferably less than 60 seconds, more preferably less than 30 seconds, and most preferably less than 15 seconds. The shorter the liquid phase retention/holding time in the flash drum, the less coking occurs in the bottom of the flash drum.

In the flash, the vapor phase 13 usually contains less than 400 ppm of non-volatiles, preferably less than 100 ppm, more preferably less than 80 ppm, and most preferably less than 50 ppm. The vapor phase is very rich in volatile hydrocarbons (for example, 55–70%) and steam (for example, 30–45%). The boiling end point of the vapor phase is normally below 1400° F.(760° C.), preferably below 1100° F. (600° C.), more preferably below 1050° F. (570° C.), and most preferably below 1000° F. (540° C.). The vapor phase is continuously removed from the flash drum 5 through an overhead pipe which optionally conveys the vapor to a centrifugal separator 38 which removes trace amounts of entrained liquid. The vapor then flows into a manifold that distributes the flow to the convection section of the furnace.

The vapor phase stream 13 continuously removed from the flash drum is preferably superheated in the pyrolysis furnace lower convection section 23 to a temperature of, for example, about 800 to 1200° F. (430 to 650° C.) by the flue gas from the radiant section of the furnace. The vapor is then introduced to the radiant section of the pyrolysis furnace to be cracked.

The vapor phase stream 13 removed from the flash drum can optionally be mixed with a bypass steam stream 21 before being introduced into the furnace lower convection section 23.

The bypass steam stream 21 is a split steam stream from the secondary dilution steam 18. Preferably, the secondary dilution steam is first heated in the pyrolysis furnace 3 before splitting and mixing with the vapor phase stream removed from the flash 5. In some applications, it may be possible to superheat the bypass steam again after the splitting from the secondary dilution steam but before mixing with the vapor phase. The superheating after the mixing of the bypass steam 21 with the vapor phase stream 13 ensures that all but the heaviest components of the mixture in this section of the furnace are vaporized before entering the radiant section. Raising the temperature of vapor phase to 800–1200° F. (430 to 650° C.) in the lo in the radiant section since radiant tube metal temperature can be reduced. This results in less coking potential in the radiant section. The superheated vapor is then cracked in the radiant section of the pyrolysis furnace.

Without further elaboration, it is believed that one skilled in the art can, using the preceding description, utilize the present invention to its fullest extent.

From the foregoing description, one skilled in the art can easily ascertain the essential characteristics of this invention, and without departing from the spirit and scope thereof, can make various changes and modifications of the invention to adapt it to various usages and conditions. For instance, although the preferred embodiment calls for the use of water to mix with the preheated feedstock in a sparger, other fluids such as naphtha can also be used.

The invention is illustrated by the following Examples which is provided for the purpose of representation and is not to be construed as limiting the scope of the invention. Unless stated otherwise, all percentages, pasts, etc., are by weight.

EXAMPLE 1

Engineering calculations which simulate processing atmospheric pipestill bottoms (APS) and crude oil by this invention have been conducted. The attached Table 1 summarizes the simulation results for cracking Tapis APS bottoms and Tapis crude oil in a commercial size furnace with a flash drum. The very light components in crudes act like steam reducing the partial pressure of the heavy components. Hence, at a nominal 950° F. (510° C.) cut point, the flash drum can operate 100° F. (50° C.) lower temperature than for atmospheric resids.

TABLE 1

Summary of Atmospheric Pipestill (APS) Bottoms and Crude Oil Flash Drum Simulations

| | APS Bottoms | Crude | FIG. 1 Ref. # |
|---|---|---|---|
| Convection feed rate, klb/hr (t/h) | 126 (57) | 100 (45) | n/a |
| 950° F. minus (510° C.), wt % | 70 | 93 | n/a |
| Temperature before sparger, ° F. (° C.) | 400 (205) | 352 (178) | 4 |
| Sparger water rate, klb/h (t/h) | 12 (5) | 43 (20) | 14 |
| Primary dilution steam rate, klb/h (t/h) | 18 (8) | 8 (4) | 17 |
| Secondary dilution steam rate, klb/h (t/h) | 17 (8) | 19 (9) | 18 |
| Desuperheater water rate, klb/h (t/h) | 6 (3) | 6 (3) | 26 |
| Flash Drum Temperature, ° F. (° C.) | 847 (453) | 750 (400) | 5 |
| Flash Drum Pressure, psig (kPag) | 107 (740) | 101 (694) | 5 |
| Feed vaporized in flash drum, wt % | 74 | 93 | 5 |
| Residue exported, klb/h (t/h) | 33 (15) | 7 (3) | 22 |

EXAMPLE 2

Table 2 summarizes the simulated performance of the flash for residue admixed with two concentrations of C4's. At a given flash temperature, pressure and steam rate, each percent of C4's admixed with the residue increases the residue vaporized in the flash by ¼%. Therefore, the addition of C4's to feed will result in more hydrocarbon from the residue being vaporized.

TABLE 2

C4's/Residue Admixture Flash Performance

| | Pure Residue | Mix 1: Residue + C4's | Mix 2: Residue + C4's |
|---|---|---|---|
| Wt % residue in convection feed | 100 | 94 | 89 |
| Wt % C4's in convection feed | 0 | 6 | 11 |
| Bubble point, ° F. @ 112 psig | 991 | 327 | 244 |
| Wt % of residue vaporized in flash | 65.0% | 68.2% | 70.8% |
| Overall wt % vaporized in flash | 65.0% | 69.9% | 74.0% |
| Temperature, ° F. | 819 | 819 | 819 |
| Wt % of residue vaporized in flash | 70.0% | 72.8% | 75.1% |
| Overall wt% vaporized in flash | 70.0% | 74.3% | 77.8% |
| Temperature, ° F. | 835 | 835 | 835 |
| Wt % of residue vaporized in flash | 75.0% | 77.4% | 79.4% |
| Overall wt % vaporized in flash | 75.0% | 78.6% | 81.7% |
| Temperature, ° F. | 855 | 855 | 855 |

Although the present invention has been described in considerable detail with reference to certain preferred embodiments, other embodiments are possible, and will become apparent to one skilled in the art. Therefore, the spirit and scope of the appended claims should not be limited to the descriptions of the preferred embodiments contained herein.

What is claimed is:

1. A process for cracking a heavy hydrocarbon feedstock in a furnace having at least a convection section and a radiant section; said process comprising:

(a) heating said heavy hydrocarbon feedstock in said convection section to form a heated feedstock;

(b) introducing a fluid and steam to said heated feedstock to form a mixture;

(c) heating said mixture in said convection section to form a heated mixture; said heated mixture having a vapor phase and a liquid phase;

(d) substantially separating said vapor phase and said liquid phase;

(e) feeding the separated vapor phase to said radiant section to crack at least a portion of hydrocarbons in said separated vapor phase;

(f) varying the rate of introduction of said fluid and the rate of introduction of said steam in response to changes in at least one operating parameter of said process to maintain the ratio of said separated vapor phase to the separated liquid phase substantially constant.

2. The process of claim 1, wherein said at least one operating parameter of said process is at least one of: the temperature of said heated mixture; the pressure of said heated mixture; the flow rate of said heated mixture, the quantity of oxygen in the flue gas of said furnace; the concentration of volatiles in said heavy hydrocarbon feedstock; and the furnace load.

3. The process of claim 2, further comprising monitoring said at least one operating parameter.

4. The process of claim 1, further comprising monitoring said ratio of said separated vapor phase to the separated liquid phase by monitoring the temperature of said heated mixture.

5. The process of claim 1, wherein said fluid comprises at least one of liquid hydrocarbon and water.

6. The process of claim 1, wherein said fluid comprises water.

7. The process of claim 6, further comprising maintaining the hydrocarbon partial pressure of said mixture substantially constant.

8. The process of claim 7, further comprising holding the sum of the rate of introduction of water and the rate of introduction of steam substantially constant.

9. The process of claim 8, further comprising using the heat of vaporization of water to control the temperature of said heated mixture after step (c) but prior to step (d).

10. The process of claim 1, wherein secondary dilution steam is superheated in said convection section and then mixed with said mixture before said flash.

11. The process of claim 10, wherein a portion of said secondary dilution steam is mixed with said heated mixture before step (c) and another portion of said secondary dilution steam is mixed with said separated vapor phase.

12. The process of claim 1, wherein about fifty percent (50%) to about ninety-five percent (95%) of hydrocarbons in said heavy hydrocarbon feedstock are in said separated vapor phase.

13. The process of claim 1, wherein at least a portion of said separated vapor phase is heated in said convection section to form a heated vapor phase and said heated vapor phase is fed to said radiant section in step (e).

14. The process of claim 13, wherein the temperature of said heated vapor phase is from about 800° F. (430° C.) to about 1200° F. (650° C.).

15. The process of claim 1, wherein said heavy hydrocarbon feedstock comprises at least one of steam cracked gas oil and residues, gas oils, heating oil, jet fuel, diesel, kerosene, gasoline, coker naptha, steam cracked naphtha, catalytically cracked naphtha, hydrocrackate, reformate, raffinate reformate, Fischer-Tropsch liquids, Fiseher-Tropsch gases, natural gasoline, distillate, virgin naphtha, crude oil, atmospheric pipestill bottoms, vacuum pipestill streams including bottoms, wide boiling range naphtha to gas oil condensate, heavy non-virgin hydrocarbon streams from refineries, vacuum gas oils, heavy gas oil, naphtha contaminated with crude, atmospheric resid, heavy residium, C4's/residue admixture, and naphtha residue admixture.

16. The process of claim 1, wherein said heavy hydrocarbon feedstock comprises low sulfur waxy resid.

17. The process of claim 1, wherein about sixty percent (60%) to about eighty percent (80%) of said heavy hydrocarbon feedstock has a boiling point below about 1100° F. (590° C.).

18. The process of claim 1, wherein said heavy hydrocarbon feedstock has a nominal final boiling point of at least about 600° F. (320° C.).

19. The process of claim 1, wherein said vapor phase has a nominal end boiling point below about 1400° F. (760° C.).

20. The process of claim 1, wherein the temperature of said heated mixture is from about 600° C. (320° C.) to about 950° F. (510° C.).

21. The process of claim 1, wherein step (d) occurs in at least one flash drum.

22. The process of claim 21, wherein the pressure of said at least one flash drum is operated between about (280 kPaa) and about 200 psia (1380 kPaa).

23. The process of claim 1, wherein said fluid and said steam are introduced to said heated heavy hydrocarbon feedstock using a double sparger assembly.

24. The process of claim 23, wherein said double sparger assembly minimizes hammer of said steam and said water in the heat exchange tubes of said convection section.

25. A steam cracking process using a furnace and a flash drum, said furnace having at least a convection section and a radiant section, for processing heavy hydrocarbon feedstock; said process comprising:

(a) heating said feedstock in said convection section to form a heated hydrocarbon stream;

(b) introducing water and steam to said heated hydrocarbon stream to form a mixture stream;

(c) heating said mixture stream in said convection section to form a heated mixture stream having a vapor phase and a liquid phase;

(d) substantially separating said vapor phase and said liquid phase in said flash drum;

(e) heating said separated vapor phase in said convection section to form a heated vapor phase;

(f) feeding said heated vapor phase to said radiant section to crack at least a portion of hydrocarbons in said heated vapor phase;

(g) varying the flow rate of said water and said steam in response to changes in at least one operating parameter of said process; and (h) holding the sum of said water flaw rate and said steam flow rate substantially constant to maintain the ratio of said separated vapor phase to said separated liquid phase substantially constant.

26. The process of claim 25, wherein said at least one operating parameter of said process is at least one of: the temperature of said heated mixture stream; the pressure of said heated mixture stream; the flow rate of said heated mixture stream, the quantity of oxygen in the flue gas of said furnace; the concentration of volatiles in said heavy hydrocarbon feedstock; and the furnace load.

27. The process of claim 26, further comprising monitoring said at least one operating parameter.

28. The process of claim 26, further comprising monitoring said ratio of said separated vapor phase to said separated liquid phase by monitoring the temperature of said heated mixture stream.

29. The process of claim 25, further comprising maintaining the hydrocarbon partial pressure of said heated mixture stream substantially constant.

30. The process of claim 29, further comprising utilizing the heat of vaporization of water to control the temperature of said heated mixture stream.

31. The process of claim 25, wherein a secondary dilution steam stream is superheated in said convection section and then mixed with said heated mixture stream.

32. The process of claim 31, wherein a portion of said secondary dilution steam is mixed with said heated mixture stream and another portion of said secondary dilution steam is mixed with said separated vapor phase.

33. The process of claim 25, wherein about fifty percent (50%) to about ninety-five percent (95%) of hydrocarbons in said heavy hydrocarbon feedstock are in said separated vapor phase.

34. The process of claim 25, wherein the temperature of said heated vapor phase is from about 800° F. (430° C.) to about 1200° F. (650° C.).

35. The process of claim 25, wherein said heavy hydrocarbon feedstock comprises at least one of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensate, heavy non-virgin hydrocarbon steams from refineries, vacuum gas oils, heavy gas oil, naphtha contaminated with crude, atmospheric resid, heavy residium, C4's/residue admixture, and naphtha residue admixture.

36. The process of claim 25, wherein said heavy hydrocarbon feedstock comprises low sulfur waxy resid.

37. The process of claim 25, wherein about sixty percent (60%) to about eighty percent (80%) of said heavy hydrocarbon feedstock has a boiling point below about 1100° F. (590° C.).

38. The process of claim 25, wherein said heavy hydrocarbon feedstock has a nominal final boiling point of at least about 600° F. (320° C.).

39. The process of claim wherein said separated vapor phase has a nominal end boiling point below about 1400° F. (760° C.).

40. The process of claim 25, wherein the temperature of said heated mixture stream is from about 600° F. (320° C.) to about 950° F. (510° C.).

41. The process of claim 25, wherein the pressure of said at least one flash drum is operated between about 40 and 200 psia (280 kPaa) and about 200 psia (1380 kPaa).

42. The process of claim 25, wherein said water and said steam are introduced to said heated heavy hydrocarbon feedstock using a double sparger assembly.

43. The process of claim 42, wherein said double sparger assembly minimizes hammer of said steam and said water in the heat exchange tubes of said convection section.

* * * * *